United States Patent [19]

Secord

[11] 4,182,254

[45] Jan. 8, 1980

[54] TANKS FOR THE STORAGE AND TRANSPORT OF FLUID MEDIA UNDER PRESSURE

[76] Inventor: Campbell Secord, Little Cheverells, Markyate, Hertforshire, England

[21] Appl. No.: 854,279

[22] Filed: Nov. 23, 1977

Related U.S. Application Data

[63] Continuation of Ser. No. 623,110, Oct. 16, 1975, abandoned.

[51] Int. Cl.[2] ..... B63B 25/08; B65D 7/38

[52] U.S. Cl. ..... 114/74 A; 220/5 A; 220/437; 220/448; 220/901

[58] Field of Search ..... 220/15, 71, 3, 1 B, 220/5 A, 9 A, 9 LG, 901, 448, 445, 437; 114/74 A

[56] References Cited

U.S. PATENT DOCUMENTS

| | | | |
|---|---|---|---|
| 1,924,966 | 8/1933 | Trainer | 285/286 X |
| 2,477,831 | 8/1949 | Schmitz, Jr. | 220/71 X |
| 2,970,559 | 2/1961 | Leroux | 114/74 A |
| 2,992,622 | 7/1961 | Maker | 114/74 A |
| 3,004,509 | 10/1961 | Leroux | 220/445 X |
| 3,067,699 | 12/1962 | Fredriks | 206/522 X |
| 3,071,094 | 1/1963 | Leroux | 220/445 X |
| 3,076,423 | 2/1963 | Leathard | 220/445 X |
| 3,092,063 | 6/1963 | Leroux | 220/445 X |
| 3,098,562 | 7/1963 | Simmons | 206/522 |
| 3,131,648 | 5/1964 | Seger | 206/522 X |
| 3,280,778 | 10/1966 | Leathard | 114/74 A |
| 3,314,567 | 4/1967 | Becker | 220/71 X |
| 3,477,752 | 11/1969 | Richter | 52/464 |
| 3,528,582 | 9/1970 | Rigollot | 220/71 X |
| 3,583,351 | 6/1971 | Gorman | 220/445 |
| 3,640,237 | 2/1972 | Phelps | 114/74 A X |
| 3,645,415 | 2/1972 | Phelps | 220/1 B |
| 3,659,543 | 5/1972 | Basile et al. | 220/901 X |
| 3,800,970 | 4/1974 | Jackson | 220/901 X |
| 3,863,460 | 2/1975 | Straile | 114/74 A X |

*Primary Examiner*—Allan N. Shoap
*Attorney, Agent, or Firm*—Rose & Edell

[57] ABSTRACT

A tank for the transport or storage of liquified natural gas under pressure is of generally rectangular form and has its side, top and bottom walls each composed of a series of parallel lobes of part-spherical cross-section and of say, 3.0 to 4.0 meters chord distance, each tank end consisting of either a like series of lobes or a mosaic of domes. All the inter-lobe nodes of the top wall of the tank are united to the corresponding nodes of the tank bottom by vertical tie-plates; likewise all the corresponding inter-lobe nodes of the two side walls are united by transverse tie-plates which intersect the vertical tie-plates orthogonally, and thereby define with them a plurality of tunnels of square cross-section.

The tie-plates extend longitudinally to unite the end walls of the tank and are welded to one another at all tie-plates inter-sections. The tank is supported on a series of parallel support ribs or frames that connect with the tank along the inter-lobe nodes of the tank bottom.

12 Claims, 5 Drawing Figures

Figure 1:
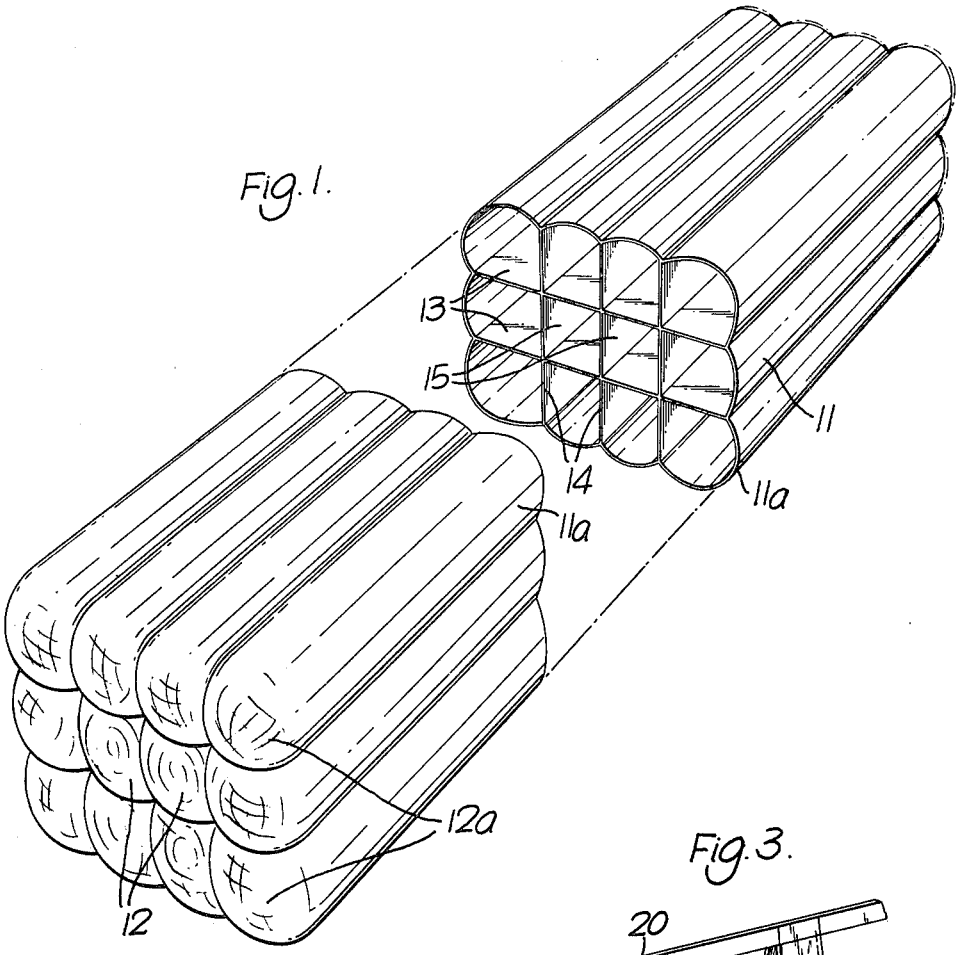

20
21
22
23
24
25
26

TANKS FOR THE STORAGE AND TRANSPORT OF FLUID MEDIA UNDER PRESSURE

This is a continuation of application Ser. No. 623,110, filed Oct. 16, 1975, now abandoned.

This invention relates to tanks for the transport and storage of fluid media under pressure. More particularly, it is concerned with tanks in ships or barges for the transport in bulk of gas liquefied under pressure by sea, including their support system in the ship's hold.

A most effective way of containing bulk fluid under pressure is the use of a tank geometry which places most if not all of the containing material in tension rather than in bending. The simplest example of this is a spherical tank. However, the overall space available for the containment is likely to be of rectangular cross-section, for example, in the case of ocean transport the space within a ship's hull, which makes it very desirable for economy of installation, both in terms of cost and space, that such tanks should be of approximately rectangular enveloping form.

The problem, therefore, is how to achieve a more or less rectangular tank that nevertheless has all its significant regions subjected to tensile rather than bending stresses.

There are a number of prior proposals to provide tanks with walls that are lobed or built up of part-circular sections but, in general, the prior workers were concerned with containment at atmospheric pressure and had no thought of how best to contain fluids at superatmospheric pressures.

It is, in fact, better to employ metal internally, e.g., in the form of tie-plates, instead of in the tank shell. Although a sphere is theoretically 13.4% lighter than the equivalent lobed tank, in practice the difference is nearly reversed due to the sphere's higher hydro-static pressure, to the fact that the thickness tolerance and weld factor apply to the whole vessel (but not to internal plates in lobed tanks), to the need for meridional thickening of the sphere for support, and to internal gear not required in the lobed tank.

According to the present invention, there is provided a tank for the storage and transport of fluid media under pressure, which is of approximately rectangular cross-sectional form and has top, bottom and side longitudinal containing walls each composed of a multiplicity of part-cylindrical lobes, and end walls composed of domes or lobes, with internal orthogonally intersecting tie-plates connecting the inter-lobe nodes of opposite containing walls whereby the tank interior is divided into parallel tunnels of rectangular, e.g. square, cross section defined by the tie-plates.

The tank's ends may be composed of square-based domes, or lobes extending in the vertical and/or transverse directions. In a dome-ended tank, at the corners and at the edges where the lobes forming the sides, top and bottom meet the end walls, part-spherical knuckles may be provided in order to effect transition from the lobes of the side walls to the domes of the end walls without any change in radius of curvature or arc chord and with the tank plates meeting tangentially at all junctions. In a tank with lobed ends the transition from longitudinal walls to end walls can be accomplished by means of fillets or knuckles.

In the preferred form, the tank end walls comprise square-based domes; and the lobes of the longitudinal side walls run longitudinally from one end of the tank to the other so that the tunnels defined by the intersecting tie-plates are horizontal, either longitudinal or transverse. It is also possible, however, that the tunnel orientation may be vertical.

We find it is better for the lobes to have arcs of 50° to 90°, and especially 60° to 70°, rather than arcs as big as 180°. At a given pressure duty and module or internodal distance the weight/volume ratio is minimized by using 180° lobe angle; but this is only increased about 3% by going to 60°–70° lobe angle, which is preferred because it offers decisively better weld access from both sides to the lobe/plate Y-joints and 4% better use of available hold volume, increasing ship deliverability and so its value proportionally, which is worth more than the higher tank weight cost. It also has the incidental convenient result of making shell and plate thicknesses nearly equal. Furthermore, when the tank ends are formed by lobes, employing a comparatively small lobe angle gives comparatively flat end fillet joints.

In such a tank, the smoothly curved regions of the lobes are in tension rather than under bending stress when the tank is subjected to internal pressure; and the 'nodes' where adjacent curves meet are supported internally by the tensile plates running both along and across the tank and also from top to bottom.

If the tank has the same cross-section throughout its length, the vertical tie-plates advantageously extend longitudinally so that the square tunnels defined by the tie-plates are likewise longitudinal. The vertical plates will then extend right up to the tank end walls and be welded thereto but the horizontal plates need not if the ends are lobed. However, for a tapered tank to fit into the hull of a ship where the cross-section is decreasing in the bow and stern, if the tunnels are longitudinal then they become rectangular and smaller in cross-section as the tank tapers and the construction becomes overheavy. In these circumstances it is preferred that the vertical plates and the tunnels run transversely.

With the use of internal partition plates the tank becomes essentially cellular and has the advantage that any tank wall lobe rupture is prevented from propagating to adjacent wall lobes, and spillage of cargo is minimized.

For a given pressure duty, the tank weight/cargo volume ratio is reduced when the tank module or internodal distance is reduced (reaching a theoretical minimum at zero module when the shell "disappears"); but in practice, a balance must be struck between the advantage of forming and assembling narrow plates, and the associated increase in welding, the optimum being generally in the range 3.0–4.0 meters or close thereto, which is also optimum for access during construction and inspection.

In prior proposals for lobed tanks the lobes have, in general, been very few, the tank being more or less a bundle of large spheres or cylinders. These do not fit the shape of a ship's hull well and also they require a large amount of metal just to support themselves.

With tanks according to this invention, the hull space can be occupied very well and the tank metal is, as it were, redistributed to advantage.

Tanks according to the invention are particularly advantageous for the carriage by sea of liquified gases at low temperatures (say −100° C. to −140°) and under high pressure (say 4 to 10 atmospheres). The occupancy of the ship's hold volume can be as high as 85% or even 90%; and the tank construction allows free contraction on cooling and expansion with pressure in all directions.

There is no criticality in regard to the extent to which the tanks are filled, e.g., they can be filled completely with liquid or to leave ullage, as desired. With liquified natural gas cargo carried below −100° C. and above 4 atmospheres gauge, it may preferably be loaded with approximately, 1½% ullage, but at sea it will then be transported in the two-phase condition with the tank "liquid-full", at a pressure sufficiently below its bubble point (at the same density) to avoid withdrawal of cargo during the loaded voyage, and to accommodate accidental excess heating as may for example occur due to flooding of a hold.

A big practical advantage with such tanks is that they provide, so to speak their own scaffolding, both during erection and also for facilitating inspection and maintenance in service.

With the use of such lobed tanks for the containment of gas or liquid under pressure in a ship it is necessary to arrange supporting systems in the hull that allow for a number of factors. The supports must carry the vertical load including marine accelerations and hold the tank fixed against displacement within the hull while at the same time contraction and expansion is permitted when the tank is cycled thermally or under internal pressure. Furthermore, inspection should preferably be possible, from both sides at all faces. The supports must be such as to minimize bending loads; and if the contained fluid is refrigerated (cryogenic) there should be a minimisation of heat leak through the supports into the tank.

In an advantageous arrangement, a tank as described is supported underneath by vertical supports in the form of ribs or frames extending the width or length of the tank and located immediately under the nodes or intersections of adjacent bottom lobes of the tank. By this means the cargo load is transmitted by the lobes slung in tension between the support frames, only the weight of the tank itself being carried down through the internal vertical plates as a comparatively small compressive stress. Saddle supports may also be provided at the bottom longitudinal edges of the tank. Since the tank is very rigid longitudinally it may have overhung ends.

In an embodiment with support frames extending across the width of the ship, each such support can be divided into several sections, the centre one being almost rigid while the outer sections are free to slide longitudinally. So far as anchorage of each support to the hull is concerned, appropriate provision needs to be made to accommodate thermal contraction of the base plate. Bottom edge saddle supports (not secured to the tank) can be provided to carry overhung loads.

Supports running widthwise of the tank entails that the lobes forming the top and bottom tank skins and the internal tunnels shall likewise run widthwise. Also, a central longitudinal bulkhead is needed in each tank to provide adequate ship stability when the tanks are part-full, e.g. carrying LNG with ullage. The central bulkhead will need to take quite heavy loading and in certain cases it may be more advantageous to utilise tanks that are split longitudinally. With widthwise running supports it is possible to achieve a support system that is fully compatible with deflections of the ship's hull at the tank top without imposing bending stresses on the tank. There is no need for side supports or top or end 'stops'. The side loads are carried hammock-wise like the bottom loads but via tensile stresses in the vertical plates as well as the side lobes. As a result, the weight, cost and heat-leak of the entire support system is minimised. The tank can be built on its supports so none have to be fitted in the ship's hold before or after tank installation. There is also a saving in weight of 5–6% in the case of tapering tanks at the bow and stern as compared with the use of longitudinally extending supports.

The use of longitudinally-extending supports means that incompatibility of the tank and the ship as regards flexure needs to be accommodated in some holds but this is not normally a serious problem and in some cases longitudinal supports are to be preferred.

A satisfactory support system employing longitudinally-extending supports comprises longitudinal A-frames both under and above the tank, with the bottom supports welded via appropriate cruciform insert sections to the bottom nodes of the tank, and the top supports slidingly engaged with corresponding inserts by e.g. a tongue-and-groove arrangement to accommodate vertical tank contraction and vertical and horizontal expansion. Alternatively, the bottom supports may also have tongue-and-groove attachment; but in this case, end stops or "prows" are required to limit axial movement. The insert sections may be substantially cruciform but with the side arms of the cruciform section drooping downward (considering the insert sections at the bottom of the tank) to match the tank lobes. In addition, saddle supports may be provided at the bottom edges to carry overhanging loads. To preserve uniform load distribution without imposing bending loads on the tank when the hull tank top deflects longitudinally, sealed hydraulic envelopes can be placed under the bottom supports (but not under the saddles) in some or all of the tanks in a hull. Another solution is to make the tank 'flexible' lengthwise by vertical corrugation of its vertical plates but the consequent increase in the horizontal plate stress involves adding significantly to the tank weight.

Instead of employing top longitudinal supports it is possible to provide side supports, which need to be yieldable in some degree to accommodate expansion and contraction for which purpose they may incorporate adjustable hydraulic pads. Although it is preferred that the supports are welded to the tank, or located laterally by a tongue-and-groove arrangement, it is also possible for the tank to sit free on the supports, particularly for stationary storage tanks. For-and-aft creep can be prevented by providing upturned prow-like extensions at the ends of the bottom supports or by means of end-stops.

Figure 3:
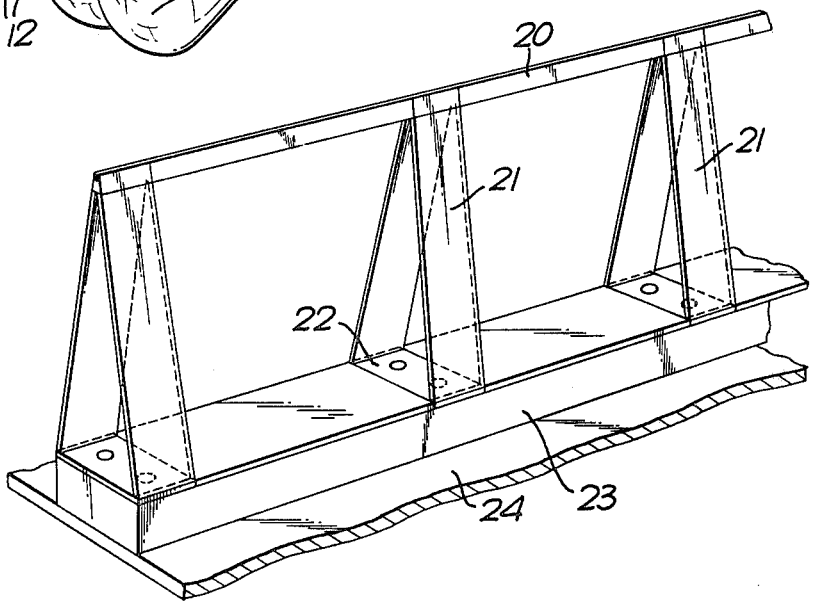
Figure 2:
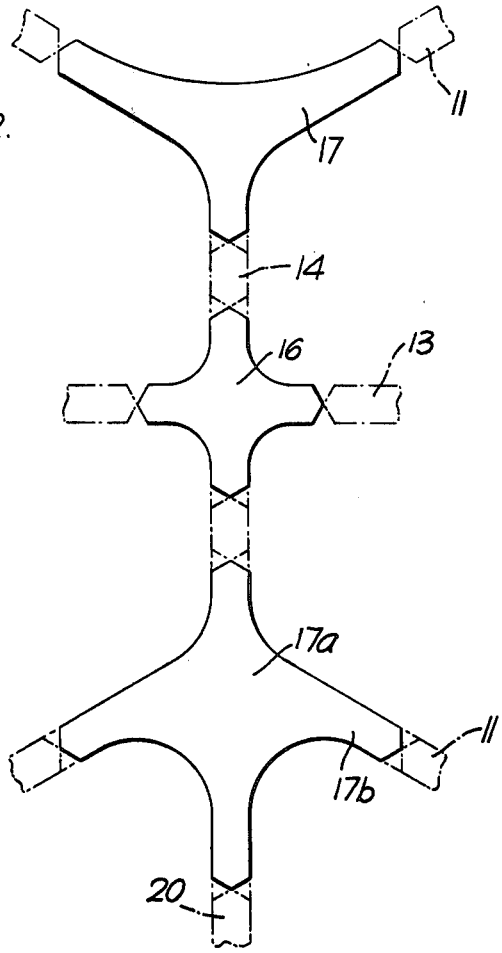
Figure 5:
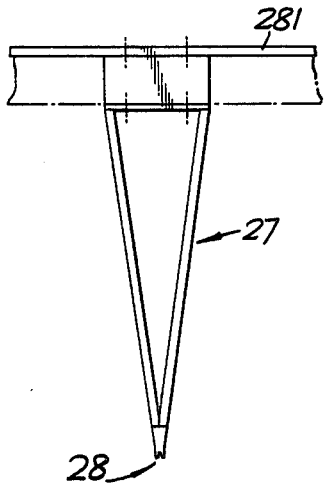
Figure 4:
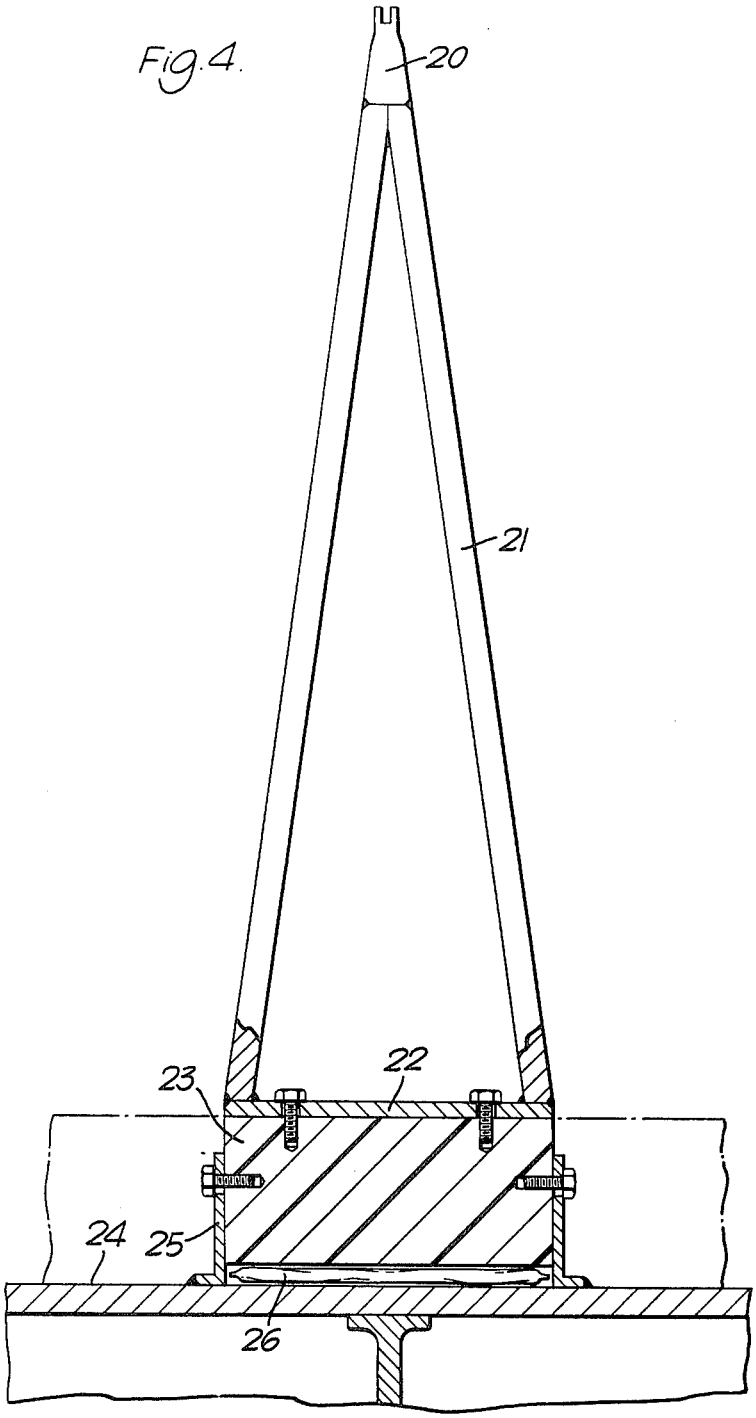

Arrangements according to the invention will now be described by way of example and with reference to the accompanying drawings in which:

FIG. 1 is a pictorial view partly cut away, of a tank with end walls consisting of domes, FIG. 2 is a detail view showing how the tank of FIG. 1 is fabricated, FIG. 3 is a pictorial view of a bottom support for the tank, FIG. 4 shows the bottom support of FIG. 3 in cross-section, and FIG. 5 shows a top support for the tank in cross-section.

Referring firstly to FIG. 1, the tank shown is intended for installation in a ship for the transport in bulk of liquified natural gas at a pressure of 5 to 10 atmospheres absolute, which reduces the refrigeration requirement (−115° C. to −135° C.) as compared with liquified natural gas transport at atmospheric pressure (−161° C.). When installed in a ship the tank will be one of a series accommodated in the hold spaces of the hull, the tanks at the bow and stern being tapered. However, the same tank construction can be employed for terminal storage on-shore or in barges.

The tank is of 9% nickel or similar steel and has a generally rectangular cross-section. The shell of the tank comprises top, bottom and longitudinal sidewalls composed of outwardly convex part-cylindrical parallel lobes 11 extending horizontally from end to end of the tank. Although in the tank shown there are only four lobes across the width and three in the depth of the tank, it is to be understood that this is a simplification for purpose of illustration and in practice there will ordinarily be greater numbers of lobes. The lobes each have an arc of about 65°, except for the corner lobes 11*a* which have much larger arcs of about 155° in order to join the sides of the tank to the top and bottom. The end walls of the tank are composed of square-based domes 12, with part-spherical knuckles 12*a* terminating the lobes of the tank sides, top and bottom at the tank ends. All the lobes, domes and knuckles have the same radius of curvature; and in the tank shown, the module size, that is to say the chord length of each lobe (except the corner lobes) is the same in all four longitudinal walls. However, for a tapering bow or stern tank the module size would vary along the tank if it is installed longitudinally.

At the intersection planes of the lobes, that it is to say the 'nodes' between consecutive lobe arcs, internal tie-plates are fitted in horizontal and vertical parallel series 13, 14 running longitudinally of the tank and thereby dividing the tank interior into a multiplicity of longitudinally-extending cells or square tunnels 15. The complete structure is welded at every intersection and at every inter-lobe node, so that the shell sides are tied across laterally and the shell top and bottom are tied together vertically. Also, the internal plates are joined at their ends to the inter-dome nodes so that the ends of the tank are likewise tied together longitudinally. The axial passages formed by the internal tunnels must be interconnected, for fluid flow during loading and discharge of the tank and other reasons, and this is achieved by providing oval or otherwise rounded openings near the ends of all the tie-plates 13, 14 at regions where the principle stresses fall off to the minor stress so that the openings may require no compensation. In the vertical plates, openings may be provided at the tops of the plates only.

FIG. 2 shows the manner of fabrication of the tank structure. At the intersections of the horizontal and vertical internal tie-plates 13, 14 the joints are made by welding in joint pieces 16 of cruciform cross-section. Insert pieces 17 of generally Y-cross-section are used to make welded joints between the tie-plates and lobes 11 of the tank shell and in this case the insert pieces are larger. Where external tank supports are to engage the tank at the inter-lobe nodes, as hereinafter described, cruciform inserts 17*a* are used, in place of the Y-inserts 17, and, considering the bottom cruciform insert pieces for instance, the lateral arms 17*b* of the cruciform inserts 17*a* are drooped to the same angular positions at the arms of the Y-inserts 17, so as to match the ends of the lobe arcs. The construction shown allows free access to both sides of all welds, ensuring 100% weld penetration without backing plates and facilitating subsequent radiographic inspection of the welds. With increase in the angle of the lobe arcs above 70°, weld access becomes progressively more difficult.

As already stated, the internal plates extend to the intersection lines or nodes of the part-sperical square-based domes 12 at the tank ends and it is essential that the internal staying extend continuously from one end of the tank to the other in that manner. Thus, the construction of the tank allows all pressures to be borne by tensile loads in the shell plating of the tank and in the internal staying structure. For example, if a longitudinal lobe is considered the force on this lobe is dependent on the lobe radius and the pressure inside the tank. This force is sustained by the tie plates running across the tank which are loaded directly in tension. The actual containment at the shell is by means of tensile loads in part-cylindrical lobes, no bending stresses being involved.

As far as the ends are concerned, similar considerations apply. Here the load to be borne by a dome is the pressure force on the area covered by one part-spherical dome and this is sustained by the longitudinal tie-plates connecting with that particular dome.

The internal plates running longitudinally carry their principal loads from top-to-bottom and side-to-side respectively. But in the longitudinal direction, the end-load is carried by the vertical and horizontal plates jointly and the top-bottom-side lobes jointly, at approximately half of the transverse stress. Due to the resulting constant energy of distortion effect, the principle stress in all plates and lobes is reduced by $\sqrt{3}/2$, and the required thicknesses correspondingly.

The weight of a tank constructed as described can be less than that of a conventional spherical or cylindrical tank for the same pressure and of the same capacity. In the present construction the loading is sustained by the internal structure whereas in a conventional tank it is sustained by the shell; and a tolerance or oversize thickness has to be provided in the case of shell plating whereas that is not necessary for the internal structure of the present tank. Also, a weld allowance need be applied to the shell plating only. As has already been mentioned, the smaller the radius of the lobes and domes the thinner can be the shell plating. A great advantage in having thinner plating is that the depths of the welds required to build the tank are reduced.

To provide a tank that tapers, to fit within a ship's hull end of reducing cross-section, if the tank lobes extend longitudinally in the ship it is only necessary to progressively reduce the arc length of the lobes while keeping the same lobe radius.

In a typical construction, the internal plates might be, say 11 millimeters thick and the shell plating 7 millimeters thick. Such a tank can be designed, by appropriate choice of the relative plate thicknesses, such that there are different stress levels in the internal plates and in the shell. It may be advantageous in certain cases to have a lower stress level in the shell plating than in the internal stays. For the low-temperature application the metal is nickel-steel but could be another suitable alloy.

In such a tank installed longitudinally a particular advantage of the internal plates is that, in the case of tanks for the transport of liquids, they elminate the problem of sloshing of the liquid loads in the tanks, and the risk of cargo roll-over.

Although as discussed herein, the structure described is for tanks to contain internal pressure, it will be understood that such tanks can also be used in applications where the internal fluid is at atmospheric pressure.

Nevertheless, in a typical example of the duty for which the tank shown is intended, 1550 Btu/scf pressurized LNG is carried at 33 lb/cub ft density at −120° C. and 110 psig(s.g.=0.529). Carriage of LNG at temperatures and pressures of this order is discussed in more detail in U.S. Pat. Nos. 3,232,735 and 3,298,805. The tank maximum pressures are 123 psig top, 134 psig mean, 144 psig bottom, and all plates can be 10 mm thick, except the domes and knuckles, giving a weight of about 1800 te, with 40,000 cubic meters of cargo volume.

Instead of ends composed of domes the tank can be constructed with lobed ends. One type of construction has vertical lobes at one end and horizontal at the other but the preferred arrangement comprises vertical lobes held together by the vertical plates. Since in this construction longitudinal and end lobes meet in what are, in effect, T-joints, special fillets are needed at the tank edges to fabricate these joints. The arrangement permits the vertical plates to be closed at the bottom to improve ship stability when part-loaded. The arrangement is somewhat heavier than domed ends but is simpler to fabricate.

Such a tank is free standing, being possessed of very great strength and stiffness in the longitudinal direction, and supported from the bottom, together with provision of stablising supports at the sides and/or top, without imposing substantial bending loads on the tank. With a tank set transversely in the ship, stabilizing supports are not required at the sides or top.

FIGS. 3 and 4 of the drawings show bottom support for the tank of FIGS. 1 and 2. A solid bar 20 of roughly triangular cross-section extends longitudinally of the ship and is supported at intervals by steel A-frames 21 to which the bottom edge of the bar 20 is welded. The top edge of the bar 20 is in turn connected to the bottom arm of a respective cruciform insert piece 17*a* of the tank bottom; if a tongue-and-groove type connection is used at this point it will permit longitudinal contraction and expansion of the tank, but a welded joint is also possible providing relative movements of the tank and hull are accommodated elsewhere. The base plate 22 of each A-frame 20 is secured down on to a longitudinal heat-insulating block 23 made of hardened wood, e.g. compressed wood impregnated with synthetic resin, which is in turn secured to the tank top 24 on the ship's hull bottom by means of brackets 25.

The sideways location of the tank is fixed and rigid because the tank lobes are themselves sufficiently flexible to accommodate expansion and contraction of the tank. If desired, this form of support can be arranged to permit longitudinal expansion and contraction movement, without transmitting the tank movements to the ship's tank-top, by the provision of elongated holes for the securing bolts. Some overhang can be allowed at the tank ends, if desired, because although the tank is flexible transversely it is extremely strong and rigid longitudinally.

In order that flexure of the ship's hull shall not impose bending loads on the tank, when the tank is longitudinal in the ship, sealed hydraulic cushions 26 are provided between the ship's tank top 24 and the hardened wood blocks 23.

Supports of similar type may be provided as required on the sides of the tanks. However, these are merely steadies and will not need to provide firm connection between the tank and the hull since the tank contracts away from them on cooling. Preferably, however, the tank is given lateral support by means of top supports such as that shown in FIG. 5. These top supports 27 are like the bottom supports inverted, with tongue-and-groove connections, as at 28, to permit relative vertical and lengthwise movement. There is no need to provide for any relative movement between the supports 27 and the ship's deck 281 to which they are secured and hydraulic cushions are not required.

At the bottom corners of the tank that extend longitudinally, curved corner saddles can be provided to sustain overhung loads, each saddle being supported from the ship's hull on two V-frames placed near the ends of the saddle. Such corner saddles provide side restraint as well as carrying the weight loads that overhang the main bottom supports. However, another way of sustaining overhung loads is by local stiffening of the internal horizontal plates. This may be necessary because of the flexibility of the tank in the transverse plane. If the bottom supports are not welded to the tank, a way of ensuring that the tank does not shift or creep bodily in the ship longitudinally is to provide the ends of the bottom supports with upturned prows to engage the tank ends.

The tank when installed in the manner described above may be insulated by means of block or sprayed plastics insulation fastened on to all surfaces of the containing hold. Advantageously, gaps are provided everywhere between the insulation and the tank for ease of access to the tank.

In tanks of the design described, not only are all stresses predominately tensile but strains in the plates and lobes are equal, the flexibility of the lobes hoopwise accommodates tank contraction and expansion readily, and the principal vertical loads impose no bending stresses on the tank. In some cases it may be advantageous to have higher stresses in the central plates than in the lobes.

Although the case in which the lobes of the longitudinal walls, and the internal tunnels, run vertically has not been particularly discussed herein it is a construction that has certain advantages, notably in regard to support since such a tank requires welded bottom supports only.

What we claim is:

1. An internal-pressure-sustaining insulatable tank of generally rectangular cross-section for the storage and transport of fluid media under pressure, comprising a bottom wall, a top wall, two opposite longitudinal side walls and two opposite end walls, an internal framework of plates, bottom supports and top supports; each of said bottom, top and side walls consisting of a multiplicity of equal-sized parallel lobes, each lobe of part-cylindrical form having an arc in the range 50° to 90° and being convex outwardly of the tank with each of its two inwardly-directed longitudinal edges joined to both a longitudinal edge of a lobe alongside and an edge of a plate of said internal framework; each of said end walls consisting of a multiplicity of equal-sized convex end wall elements having the same radius of curvature as said lobes and each joined at its inwardly directed edges to the end wall elements alongside and to plates of said internal framework; tank corner elements being provided to unite said bottom, top, side and end walls to one another, said corner elements being convex and of the same radius of curvature as said lobes but with larger arcs; said internal framework consisting of two orthogonally intersecting series of parallel plates, each plate in one series extending from the joint between two lobes of one side wall to the respective opposite joint of the opposite side wall, each plate in the other series extending from the joint between two lobes of the bottom wall to the respective opposite joint between two lobes of the top wall, and the plates of at least one of said series extending longitudinally and being also united to the joints of the opposite end walls so that the tank end walls are tied to one another longitudinally; the joints at the intersections of the two series of plates being formed by cruciform section insert elements with the end edges of the four arms of the cruciform welded to respective plates, the joints between the bottom wall lobes and plates of the internal framework being formed by bottom insert elements having a crosssection that is generally cruciform with vertical top and bottom arms and downwardly drooped side arms, the side arms being welded to the respective bottom wall lobes and the top arms being welded to the respective internal plates, the joints between the side wall lobes and the plates of the internal framework being formed by Y-section insert elements with the arms thereof welded to the respective side wall lobes and internal plates, and at least some of the joints between the top wall lobes and the plates of the internal framework being formed by top insert elements having a cross section that is generally cruciform with vertical top and bottom arms and upwardly inclined side arms, the side arms being welded to the respective top wall lobes and the bottom arms being welded to the respective plates; and wherein said bottom supports include longitudinally-extending grooves which are located under the tank and slidably engage with the bottom arms of the bottom insert elements to thereby support and permit longitudinal expansion of the tank with space below the lowermost parts of the bottom wall lobes, and said top supports are located above the tank and engage the top arms of the top insert elements.

2. A tank according to claim 1, wherein the tank end walls are composed of square-based domes.

3. A tank according to claim 1, wherein the lobes of the tank longitudinal side walls run longitudinally from one end of the tank to the other so that the tunnels defined by the intersecting tie-plates are horizontal.

4. A tank according to claim 3, wherein the cross-section of the tank is uniform throughout its length and the lobes of the top and bottom walls run longitudinally so that the tunnels defined by the intersecting tie-plates are also longitudinal.

5. A tank according to claim 1, wherein the lobes have arcs of substantially 65°.

6. A tank according to claim 1, wherein the module distance between consecutive inter-lobe joints is in the range 3.0–4.0 meters, especially 3.5 meters.

7. A tank according to claim 1, wherein the principal stress in the tie-plates is higher than the hoop stress in the lobes.

8. A tank according to claim 1, wherein the bottom supports are in the form of upright A-frames located immediately under the joints between adjacent bottom lobes of the tank.

9. A tank according to claim 8, wherein the lobes of the tank top and bottom are longitudinal and the supports extend longitudinally.

10. A tank according to claim 9, installed in a ship, wherein the bottom supports incorporate hydraulic means, to avoid bending loads on the tank when the ship flexes.

11. A tank according to claim 1, wherein the top supports above the tank are connected thereto by joints that allow relative sliding.

12. An internal-pressure-sustaining insulatable tank of generally rectangular cross-section for the storage and transport of fluid media under pressure, comprising a bottom wall, a top wall, two opposite longitudinal side walls and two opposite end walls, an internal framework of plates, bottom supports and top supports; each of said bottom, top and side walls consisting of a multiplicity of equal-sized parallel lobes, each lobe of part-cylindrical form having an arc in the range 50° to 90° and being convex outwardly of the tank with each of its two inwardly-directed longitudinal edges joined to both a longitudinal edge of a lobe alongside and an edge of a plate of said internal framework; each of said end walls consisting of a multiplicity of equal-sized convex end wall elements having the same radius of curvature as said lobes and each joined at its inwardly directed edges to the end wall elements alongside and to plates of said internal framework; tank corner elements being provided to unite said bottom, top, side and end walls to one another, said corner elements being convex and of the same radius of curvature as said lobes; said internal framework consisting of two orthogonally intersecting series of parallel plates, each plate in one series extending from the joint between two lobes of one side wall to the respective opposite joint of the opposite side wall, each plate in the other series extending from the joint between two lobes of the bottom wall to the respective opposite joint between two lobes of the top wall, and the plates of at least one of said series extending longitudinally and being also united to the joints of the opposite end walls so that the tank end walls are tied to one another longitudinally; the joints between the bottom wall lobes and the plates of the internal framework being formed by bottom insert elements with vertical top arms and downwardly drooped side arms, the side arms being welded to the respective bottom wall lobes and the top arms being welded to the respective internal plates, at least one of said bottom insert elements having downwardly projecting key means integral therewith; the joints between the side wall lobes and the plates of the internal framework being formed by Y-section insert elements with the arms thereof welded to the respective side wall lobes and internal plates, and the joints between the top wall lobes and the plates of the internal framework being formed by top insert elements with vertical bottom arms and upwardly inclined side arms, the side arms being welded to the respective top wall lobes and the bottom arms being welded to the respective plates, at least one of said top insert elements having upwardly projecting key means integral therewith; and wherein said bottom supports include longitudinally-extending grooves which are located under the tank and slidably engage with the bottom insert elements to thereby support and permit longitudinal expansion of the tank with space below the lowermost parts of the bottom wall lobes, and said top supports are located above the tank and engage the top insert elements, said key means on said bottom and top insert elements cooperating respectively with said bottom and top supports to restrain bodily movement of the tank.

* * * * *

UNITED STATES PATENT AND TRADEMARK OFFICE

CERTIFICATE OF CORRECTION

PATENT NO. : 4,182,254

DATED : January 8, 1980

INVENTOR(S) : CAMPBELL SECORD

It is certified that error appears in the above-identified patent and that said Letters Patent are hereby corrected as shown below:

On the title page insert:

[73] Assignee: --Martacto Naviera S.A.,
Panama City, Panama --

Signed and Sealed this

*Eighteenth* Day of *August 1981*

[SEAL]

*Attest:*

GERALD J. MOSSINGHOFF

*Attesting Officer*

*Commissioner of Patents and Trademarks*